US007757408B2

(12) United States Patent
McClaskie

(10) Patent No.: US 7,757,408 B2
(45) **Date of Patent: *Jul. 20, 2010**

(54) SHOE HAVING IMPROVED OPANKA STITCHING

(75) Inventor: Thomas E. McClaskie, Bethlehem, PA (US)

(73) Assignee: Columbia Insurance Company, Omaha, NE (US)

( * ) Notice: Subject to any disclaimer, the term of this patent is extended or adjusted under 35 U.S.C. 154(b) by 1151 days.

This patent is subject to a terminal disclaimer.

(21) Appl. No.: 11/231,434

(22) Filed: Sep. 20, 2005

(65) Prior Publication Data

US 2007/0062064 A1 Mar. 22, 2007

(51) Int. Cl.
*A43B 13/28* (2006.01)
*A43D 11/00* (2006.01)

(52) U.S. Cl. ..... 36/12; 12/142 C; 12/142 T; 36/22 R; 36/18

(58) Field of Classification Search ..... 36/18, 36/19 R, 19 A, 21, 22 R, 11, 23; 12/142 B
See application file for complete search history.

(56) References Cited

U.S. PATENT DOCUMENTS

| | | | | | |
|---|---|---|---|---|---|
| 45,138 | A * | 11/1864 | Closs | 12/142 B |
| 318,878 | A * | 5/1885 | Day | 36/22 R |
| 2,037,970 | A * | 4/1936 | Everston | 36/19 R |
| 2,163,158 | A * | 6/1939 | Schroder | 36/19 R |
| 2,220,555 | A * | 11/1940 | Stritter | 36/19 R |
| 2,565,662 | A * | 8/1951 | McMahon | 36/19 R |
| 2,978,817 | A * | 4/1961 | Brenner | 36/97 |
| 3,414,989 | A * | 12/1968 | Odermatt | 36/14 |
| 5,784,736 | A | 7/1998 | Issler et al. | 12/142 |
| 5,893,186 | A | 4/1999 | Issler et al. | 12/146 |
| 6,029,301 | A | 2/2000 | Issler et al. | 12/142 |
| 6,574,886 | B1 | 6/2003 | Issler | 36/12 |
| 6,604,303 | B2 | 8/2003 | Covatch | 36/77 |
| 6,898,873 | B2 * | 5/2005 | Schenone | 36/112 |
| 7,454,848 | B2 * | 11/2008 | Issler | 36/12 |

* cited by examiner

*Primary Examiner*—Jila M Mohandesi
(74) *Attorney, Agent, or Firm*—St. Onge Steward Johnston & Reens LLC

(57) ABSTRACT

The invention relates to a shoe and method for providing a shoe having an outsole with an outside surface, an upper, a liner with an inside surface, and a stitch extending from the outside surface through the upper to the inside surface, where the stitch is a sole securing mechanism for securing the outsole, upper, and liner together. The stitch secures the outsole, upper, and liner together without cement.

11 Claims, 5 Drawing Sheets

SHOE HAVING IMPROVED OPANKA STITCHING

FIELD OF THE INVENTION

The invention relates to a shoe having improved construction and, more particularly, a shoe having an outsole sewn to an upper employing unique stitching.

BACKGROUND OF THE INVENTION

There are a wide variety of shoe constructions. One construction method, known as Opanka construction, includes sewing the outsole to the upper of the shoe along an outer periphery of the outsole.

Referring to FIG. 1, an Opanka shoe construction is shown. The shoe 10 includes outsole 12 being secured to the upper 14 by 2 rows of threads 16 that pass through a plurality of aligning holes in both outsole 12 and upper 14. FIG. 1 shows a perspective view of upper 14 where the top of threads 16 is depicted.

FIG. 2 shows a cross sectional view of the shoe shown in FIG. 1. As shown, threads 16 pass through both upper 14 and outsole 12 from top to bottom, and vice versa, thereby forming 2 rows of threads. To prevent threads 16 from being worn due to walking, the shoe includes a channel 18 to protect threads 16.

However, having an outsole that shows both channel and threads 16 may detract from the appearance of the shoe. FIG. 3 shows an alternative embodiment of the Opanka construction shoe shown in FIG. 1, shows where 1 row of stitches are visible on a top view of the shoe and 1 row of stitches are visible on a side of outsole 12. In this fashion, the channel 20 may be more visible on the side of the shoe as opposed to the bottom of the shoe.

What is desired, therefore, is a shoe having an improved construction. Another desire is to provide a shoe where the stitching used for securing the outsole to the upper are reduced to enhance aesthetics. A further desire is to provide a shoe that reduces the stitching employed in making the shoe without sacrificing the strength of the shoe.

SUMMARY OF THE INVENTION

It is, therefore, an object of the invention to provide a shoe having improved construction.

Another object is to provide a shoe with reduced manufacturing costs without sacrificing structural integrity.

Yet another object is a shoe with a simpler construction and improved aesthetic appearance.

These and other objects of the invention are provided by a shoe having an outsole with an outside surface, an upper, a liner with an inside surface, and a stitch extending from the outside surface through the upper to the inside surface for securing the outsole, upper, and liner together without chemical bonding, such as cement.

In some embodiments, the stitch is a handsewn stitch. In other embodiments, the stitch is an Opanka stitch. In further embodiments, the stitch is a sole securing mechanism for securing the outsole, upper, and liner together.

Optionally, a cushion may be placed between the liner and the outsole. In some embodiments, the outsole includes a lip and where the stitch extends from the outside surface, through the lip, through the upper, and to the inside surface.

In another aspect of the invention, a shoe includes an outsole being a single unit and an upper having a peripheral edge, where the peripheral edge is also a single unit. The shoe also has a lining and a stitch being a single unit for securing the peripheral edge, upper, and lining together without chemical bonding.

In some embodiments, the stitch is a sole securing mechanism for securing the outsole to the upper and liner.

Optionally, the shoe may have an insert removably placed on the liner for cushioning a user's foot. This insert may be a footbed.

In a further aspect of the invention, a method for providing a shoe includes the steps of providing an outsole with an outer surface, providing an upper, providing a liner with an inside surface, and passing a stitch from the outside surface through the upper to the inside surface without using chemical bonding. The method may use a stitch as a securing mechanism for securing the outside surface, upper, and inside surface without cement.

The method may include the step of handsewing the stitch. The method may also optionally include the step of inserting a cushion between the liner and outsole.

The method may include the step of providing an outsole of a single unit or providing a stitching of a single unit.

DETAILED DESCRIPTION OF THE DRAWINGS

Figure 1:
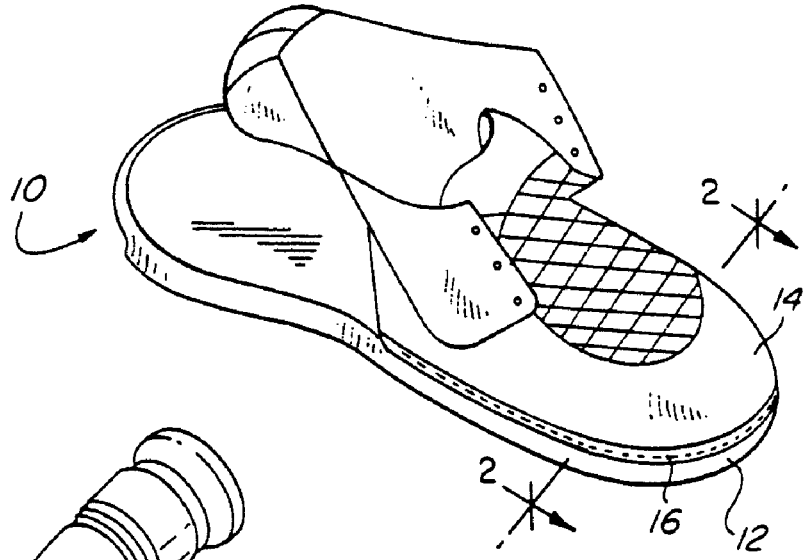
FIG. 1 Prior Art
FIG. 1 depicts a shoe representing the prior art.
Figure 2:
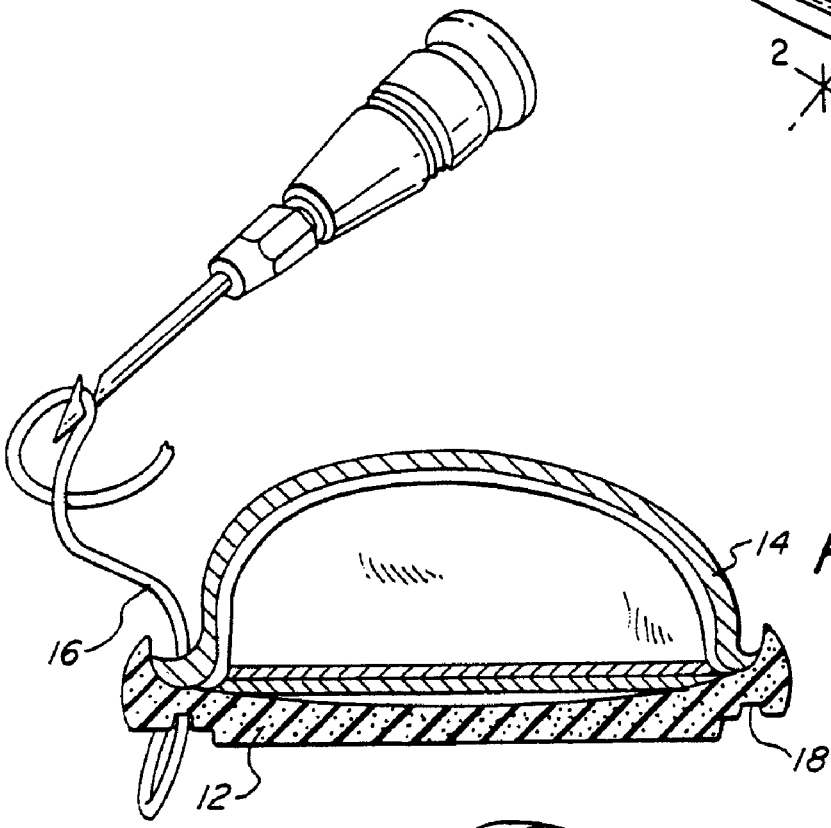
FIG. 2 Prior Art
FIG. 2 depicts a cross sectional view of the shoe shown in FIG. 1.
Figure 3:
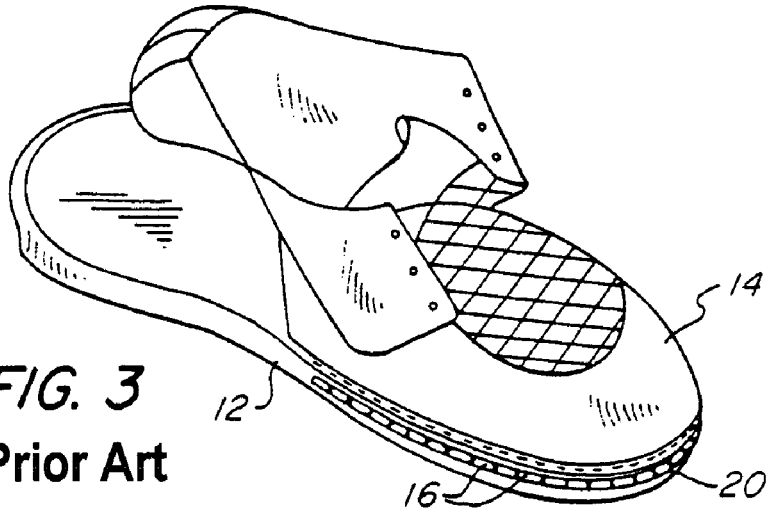
FIG. 3 Prior Art
FIG. 3 depicts a cross sectional view of another embodiment of the shoe shown in FIG. 1.

FIGS. 1, 2, and 3 depict a shoe having a traditional Opanka stitching. As shown, in addition to the first row of stitches visible from a top view of the shoe, thread 16 used to sew upper 14 to outsole 12 exposes a second row of stitches on a side or a bottom of the shoe 10. Exposing 2 rows of thread 16 on either the side or bottom of shoe 10 presents the disadvantages described above.

Figure 4:
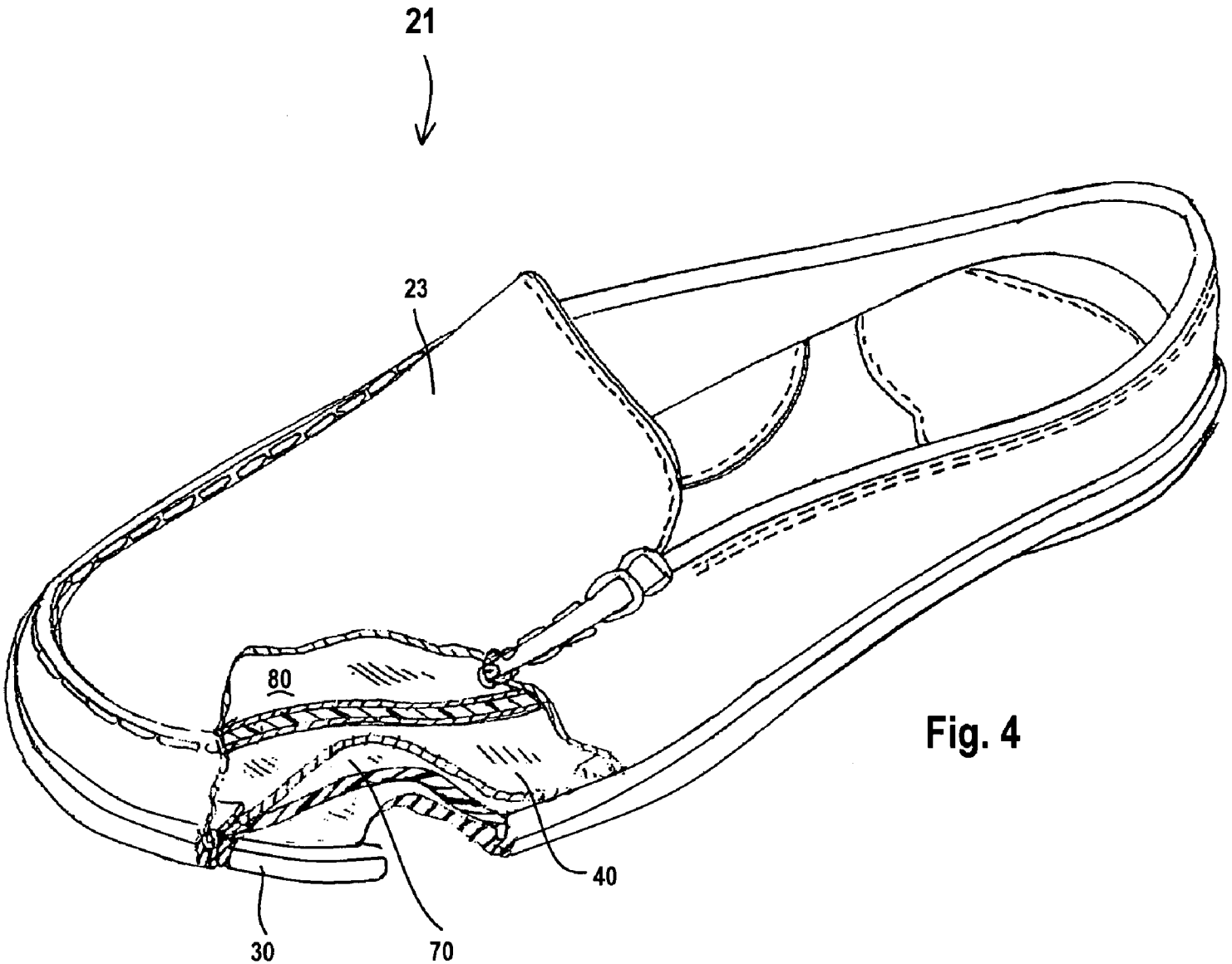
FIG. 4 depicts the shoe in accordance with the invention.

FIG. 4 depicts shoe 21 in accordance with the invention. Shoe 21 includes upper 23, outsole 30, lining 40, and securing mechanism 50 for securing upper 23, outsole 30, and lining 40 together.

Figure 5:
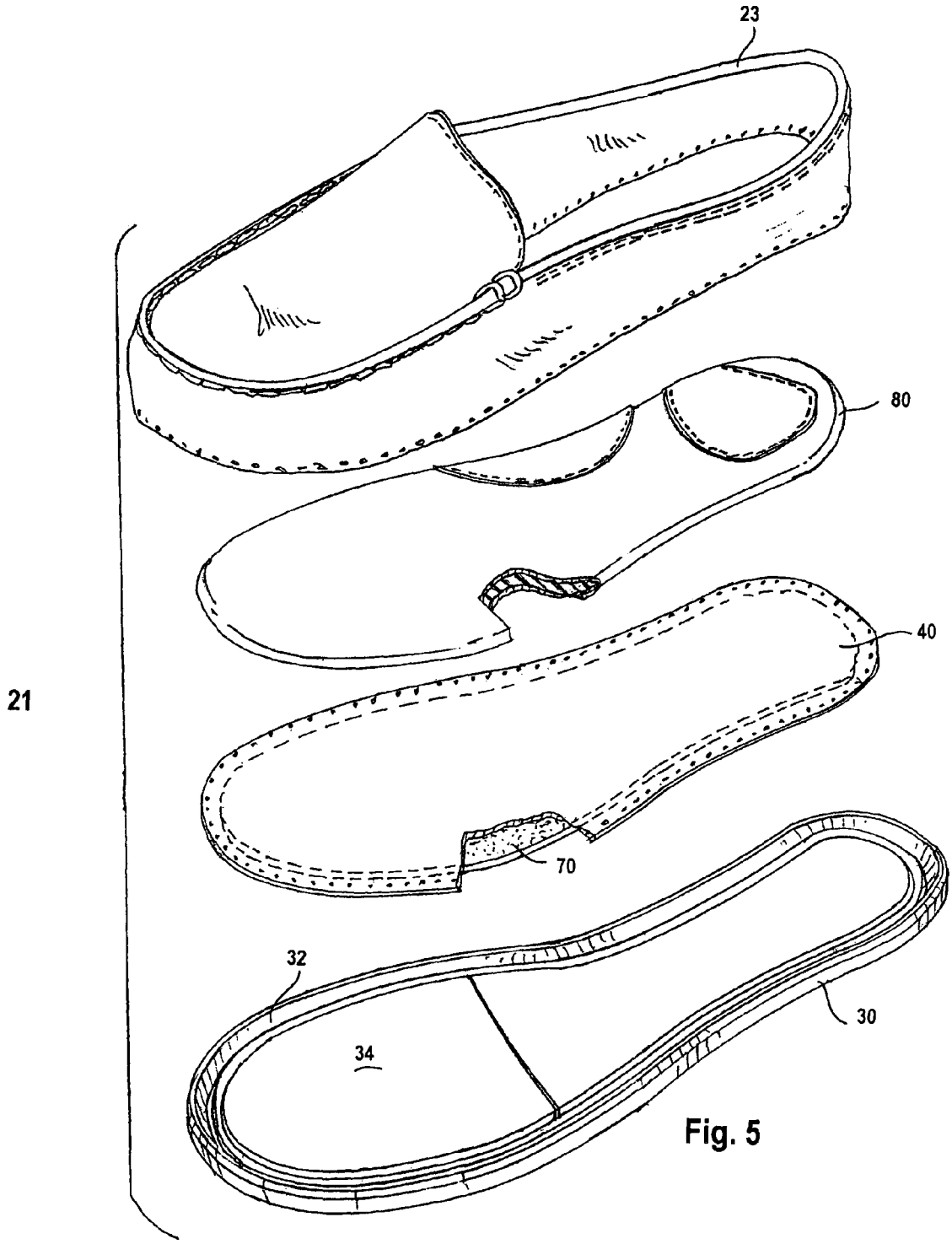
FIG. 5 depicts an assembly view of the shoe shown in FIG. 4.
Figure 6A:
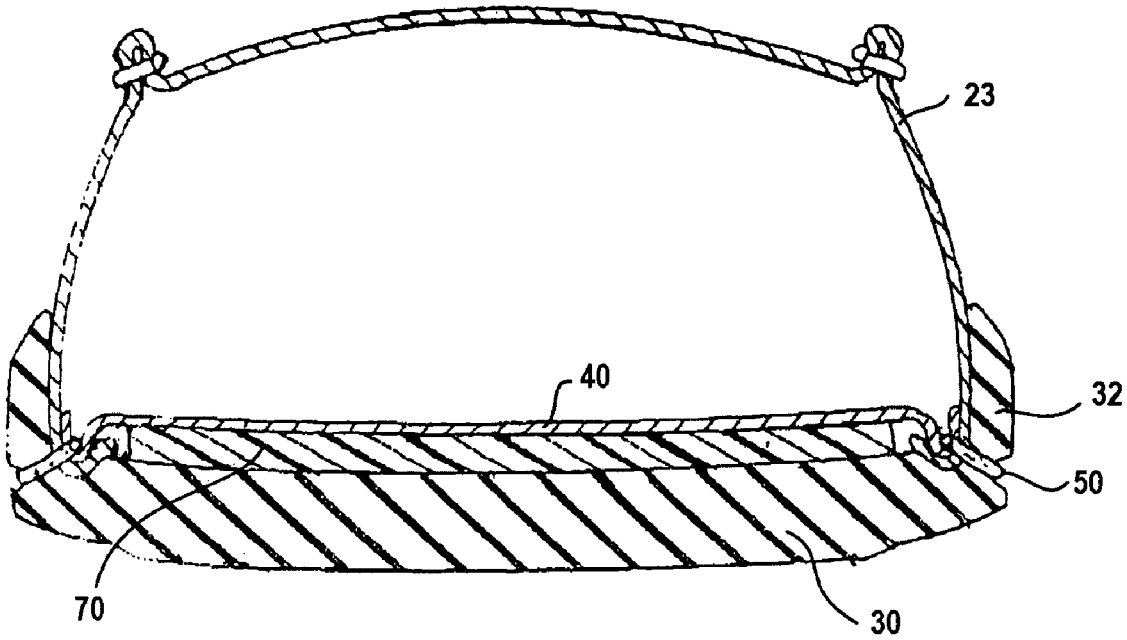
FIG. 6*a* depicts a cross sectional view of the shoe shown in FIG. 4.
Figure 6B:
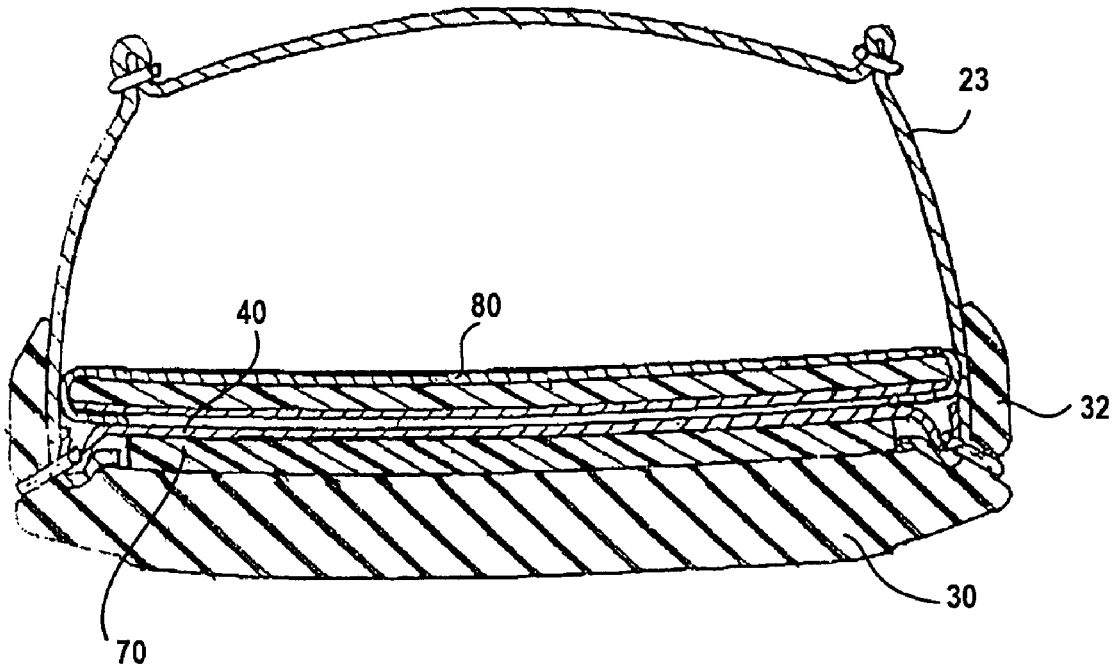
FIG. 6*b* depicts a cross sectional view of the shoe shown in FIG. 4 with an insertable footbed.

As shown in FIGS. 5, 6*a*, and 6*b*, outsole 30 has a peripheral lip 32 for providing a structure to which securing mechanism 50 is secured. Although lip 32 is shown to extend around the entire periphery of outsole 30, this is not a requirement. In other embodiments, lip 32 extends around localized areas of outsole 30 wherever securing mechanism 50 is desired to secure upper 23 and lining 40 to outsole 30.

Further, as shown, securing mechanism 50 is a stitch of any known or novel material, such as leather, wire, yarn, string, fishing line, plastic, and the like.

The invention relates to a simplified shoe utilizing upper 23, outsole 30, lining 40, and stitch 50 to provide a handsewn shoe with only 1 row of stitches being visible and without other materials, such as an insole, welt midsole, or chemical bonding such as cement.

Chemical bonding, such as glue, cement, adhesive, tape, and the like, often inhibits the materials that are bonded from moving relative to one another. Therefore, when bonded materials are bent or flexed, as often is the case during the process of walking, flexibility may be reduced because, instead of two separable layers sliding relative to one another, the two materials are acting as a single unit with double the thickness as two separable layers. Hence, a single unit with double the thickness may be harder to bend than two separable layers, each one having half the thickness as the single unit. Moreover, the inability of the two layers to slide relative to one another due to the chemical bonding exacerbates the problem of inflexibility.

It should be noted that securing mechanism 50, or stitch, is the sole structure used to secure upper 23, outsole 30, and lining 40 together without cement, fasteners, nails, rivets, or other securement means. In some embodiments, stitch 50, or securing mechanism, is handsewn or an Opanka type stitch.

Stitch 50 being the sole structure used to secure upper 23, outsole 30, and lining 40 together reduces manufacturing costs as fewer steps are needed to complete shoe 21. For example, no lasting is needed and shoe 21 does not require a tuck. Moreover, without chemical bonding or cement, there is a reduction in cleanup costs and/or material savings as cement need not be purchased as typically required with traditionally manufactured shoes.

Lining 40 provides a smooth surface to support a user's foot. Sometimes outsole 30 and top surface 34 of outsole 30 may not be smooth. Lining 40 corrects the discomfort normally associated with an uneven or uncomfortable surface by providing a smooth supporting surface upon which the user's foot is placed. Lining 40 may be of leather, vinyl, cloth, cotton, or any woven or nonwoven material that covers top surface 34. Generally, lining 40 is of a strong material to resist wear from top surface 34 and/or the user's foot.

Because securing mechanism 50 is handsewn, lining 40, upper 30, and outsole 30 or lip 32 have holes through which stitch 50 may pass. These holes may be provided before or after assembly of upper 23, outsole 30, and lining 40.

Optionally, cushion 70 may be placed between lining 40 and top surface 34 to improve comfort. Also, insole material may be placed, in addition to or instead of cushion 70, between lining 40 and top surface 34 to enhance structural integrity. Again, no chemical bonding is needed to secure cushion 70 because stitch 50, positioned around at least a portion of a periphery of cushion 70, holds cushion 70 in place. In the event top surface 34 is particularly uneven or rough, insole material may be placed between cushion 70 and top surface 34 so that the unevenness or roughness may be alleviated.

Shoe 21 may also include optional insertable footbed 80 removably placed on top of lining 40. Footbed 80 is usually made of cushion material to comfort a user's foot, which is in direct physical contact with footbed 80. Footbed 80 is normally of foam, rubber, or any resilient material for providing a cushioned surface between the user's foot and lining 40.

Figure 7:
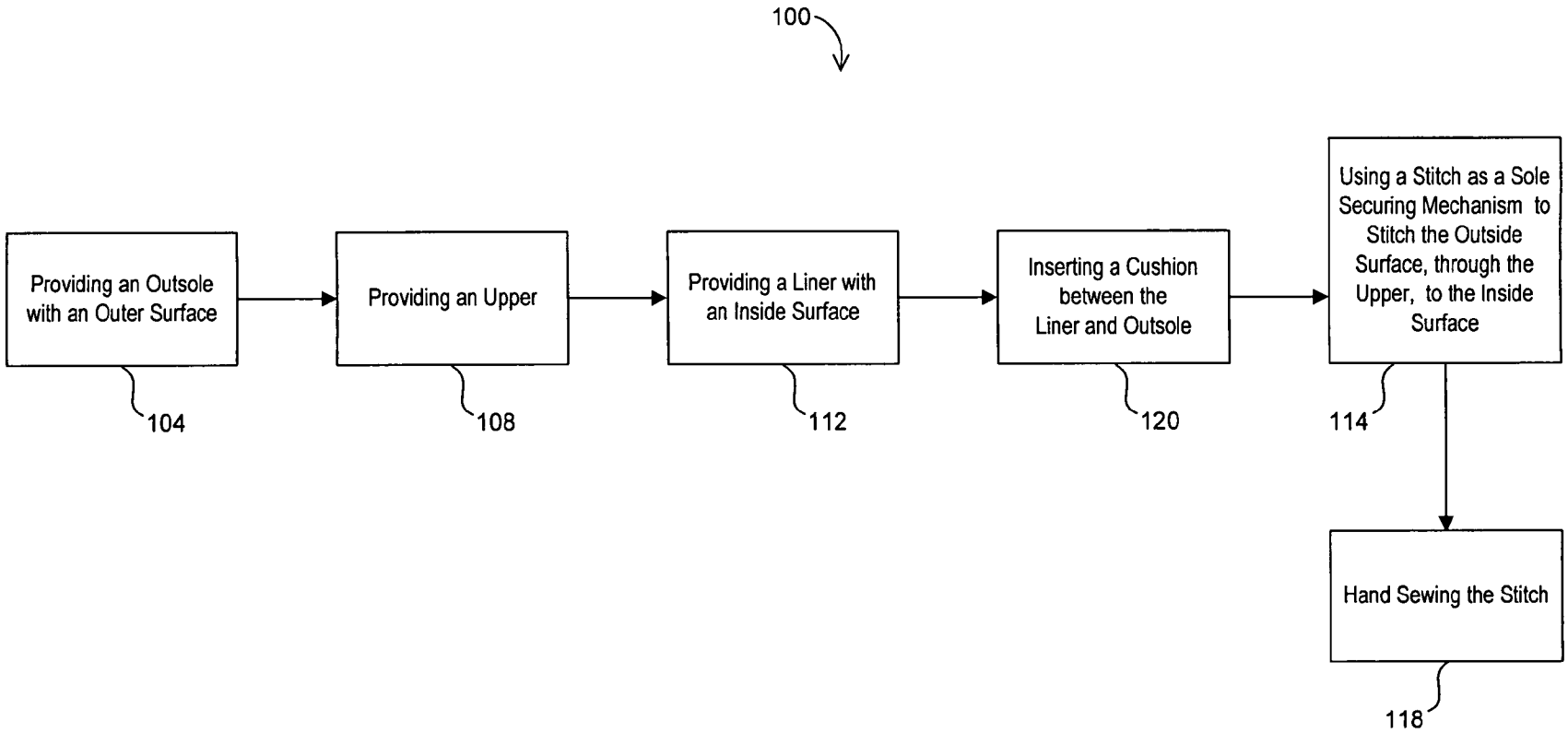
FIG. 7 depicts a method for providing the shoe shown in FIG. 4.

FIG. 7 depicts method 100 for providing the shoe in accordance with the above description. Method 100 includes the steps of providing 104 an outsole with an outer surface, providing 108 an upper, providing 112 a liner with an inside surface, and using 114 a stitch as a sole securing mechanism for stitching the outside surface through the upper and to the inside surface of the liner. The stitch is used without cement, adhesives, fasteners, and the like.

Method 100 may also include the step of handsewing 118 the stitch. Optionally, method 100 may insert 120 a cushion between the liner and the outsole to enhance comfort. Moreover, the method 100 may provide the stitch and/or the outsole as a single unit.

What is claimed is:

1. A shoe, comprising:

an outsole having a raised lip extending around at least a portion of a periphery of the outsole;

an upper;

a liner with an inside surface; and a stitch extending from said lip through said upper to said inside surface of the liner forming a single row of stitches on an outside surface of the shoe, said stitch being a sole securing mechanism for securing said outsole, said upper, and said liner together without chemical bonding.

2. The shoe according to claim 1, wherein said stitch is a handsewn stitch.

3. The shoe according to claim 1, wherein said stitch is an Opanka stitch.

4. The shoe according to claim 1, further comprising a cushion between said liner and said outsole.

5. A shoe, comprising:

an outsole being a single unit having a raised lip extending around at least a portion of a periphery of the outsole;

an upper having a peripheral edge, said peripheral edge being a single unit;

a lining; and a stitch extending from said lip through said upper to said lining, forming a single row of stitches on an outside surface of the shoe and being a sole mechanism for securing said outsole, said peripheral edge, said upper, and said lining together without chemical bonding.

6. The shoe according to claim 5, further comprising an insert removably placed on said liner for cushioning a user's foot.

7. A method for providing a shoe, comprising the steps of:

providing an outsole having a raised lip extending around at least a portion of a periphery of the outsole;

providing an upper;

providing a liner with an inside surface; and passing a stitch from the lip through the upper to the inside surface of the liner;

wherein said stitch forms a single row of stitches on an outside surface of the shoe and is a sole securing mechanism for securing the outsole, the upper, and the liner without chemical bonding.

8. The method according to claim 7, further comprising the step of handsewing the stitch.

9. The method according to claim 7, further comprising the step of inserting a cushion between the liner and outsole.

10. The method according to claim 7, further comprising the step of providing an outsole of a single unit.

11. The method according to claim 7, further comprising the step of providing a stitching of a single unit.

* * * * *